US009936763B2

(12) United States Patent
Semperlotti et al.

(10) Patent No.: US 9,936,763 B2
(45) Date of Patent: Apr. 10, 2018

(54) METHODS AND APPARATUS FOR HUMAN MOTION CONTROLLED WEARABLE REFRIGERATION

(71) Applicant: University of Notre Dame du Lac, Notre Dame, IN (US)

(72) Inventors: Fabio Semperlotti, Notre Dame, IN (US); Mihir Sen, South Bend, IN (US)

(73) Assignee: University of Notre Dame du Lac, Notre Dame, IN (US)

( * ) Notice: Subject to any disclaimer, the term of this patent is extended or adjusted under 35 U.S.C. 154(b) by 141 days.

(21) Appl. No.: 14/727,384

(22) Filed: Jun. 1, 2015

(65) Prior Publication Data

US 2015/0335096 A1 Nov. 26, 2015

Related U.S. Application Data

(63) Continuation of application No. 14/573,953, filed on Dec. 17, 2014.

(60) Provisional application No. 61/916,873, filed on Dec. 17, 2013.

(51) Int. Cl.

| | |
|---|---|
| ***A43B 7/02*** | (2006.01) |
| ***A43B 7/04*** | (2006.01) |
| ***A43B 7/06*** | (2006.01) |
| ***A43B 13/10*** | (2006.01) |
| ***A43B 7/00*** | (2006.01) |
| ***A43B 13/12*** | (2006.01) |

(52) U.S. Cl.
CPC ..... *A43B 7/005* (2013.01); *A43B 13/10* (2013.01); *A43B 13/125* (2013.01)

(58) Field of Classification Search
CPC ..... A43B 7/005; A43B 7/00; A43B 7/002; A43B 7/04; A43B 7/06; A43B 7/02; A43B 7/10; A43B 7/142; A43B 7/1475; A43B 13/10; F25B 9/14; F24F 5/0021; F28F 13/003; F28F 21/02; F28F 21/08
See application file for complete search history.

(56) References Cited

U.S. PATENT DOCUMENTS

| | | | | |
|---|---|---|---|---|
| 6,239,501 | B1 * | 5/2001 | Komarechka | A43B 3/00 290/1 R |
| 6,354,020 | B1 * | 3/2002 | Kimball | A43B 13/203 36/135 |
| 2013/0033042 | A1 * | 2/2013 | Fortier | A43B 3/0015 290/54 |
| 2014/0182164 | A1 * | 7/2014 | Krupenkin | A43B 7/02 36/2.6 |
| 2014/0196308 | A1 * | 7/2014 | Baratta | A43B 13/184 36/29 |

FOREIGN PATENT DOCUMENTS

| | | | | |
|---|---|---|---|---|
| WO | WO 2011141939 | A1 * | 11/2011 | A43B 7/10 |

* cited by examiner

*Primary Examiner* — Frantz Jules
*Assistant Examiner* — Erik Mendoza-Wilkenfel
(74) *Attorney, Agent, or Firm* — Greenberg Traurig, LLP

(57) ABSTRACT

A wearable, portable, self-contained refrigeration/cooling garment may effectively convert the energy of human movement into heat flux. The heat flux can then used to actively control the temperature of the human body or of part of it. In one example of the present disclosure, the garment is a type of footwear powered by the wearer's ambulation.

13 Claims, 3 Drawing Sheets

METHODS AND APPARATUS FOR HUMAN MOTION CONTROLLED WEARABLE REFRIGERATION

CROSS REFERENCE TO RELATED APPLICATION

This application is a continuation of U.S. patent application Ser. No. 14/573,953, filed Dec. 17, 2014, which is a non-provisional application claiming priority from U.S. Provisional Application Ser. No. 61/916,873, filed Dec. 17, 2013, each of which is incorporated herein by reference in its entirety.

FIELD OF THE DISCLOSURE

The present description relates generally to a refrigeration device and more particularly to a human motion controlled wearable refrigeration device.

BACKGROUND OF RELATED ART

U.S. Pat. No. 8,561,399 describes a compressed air energy storage system utilizing two phase flow to facilitate heat exchange. More particularly, the patent describes a compressed-air energy storage system comprising a reversible mechanism to compress and expand air, one or more compressed air storage tanks, a control system, one or more heat exchangers, and a motor-generator. The reversible air compressor-expander uses mechanical power to compress air (when it is acting as a compressor) and converts the energy stored in compressed air to mechanical power (when it is acting as an expander). A suitable valve allows air to enter and leave the pressure cell and cylinder device, if present, under electronic control.

U.S. Pat. No. 8,531,291 generally describes a wearable personal emergency response (PER) system including one or more sensors mounted on a mobile patient. A wireless transceiver communicates with a remote station, and a processor coupled to the sensor and the wireless transceiver requests assistance if the processor detects a fall by the mobile patient.

U.S. Pat. No. 8,487,456 describes a methods and apparatus for harvesting energy from motion of one or more joints. The described energy harvester includes a generator for converting mechanical energy into corresponding electrical energy, one or more sensors for sensing one or more corresponding characteristics associated with motion of the one or more joints, and control circuitry connected to receive the one or more sensed characteristics and configured to assess, based at least in part on the one or more sensed characteristics, whether motion of the one or more joints is associated with mutualistic conditions or non-mutualistic conditions. If conditions are determined to be mutualistic, energy harvesting is engaged. If conditions are determined to be non-mutualistic, energy harvesting is disengaged.

U.S. Pat. No. 7,956,476 describes a system for harvesting footwear energy. The energy may be in a form of footwear movement which involves a compression and decompression of chambers situated in the footwear. There may be a back chamber in the heel area and a front chamber in the toe area of the footwear. The chambers may be filled with gas which moves in and out upon compression and decompression of the chambers at the heel and toe areas upon the ambulatory motion of a person wearing the footwear. The moving gas may go through a pneumatic rectifier that provides a unidirectional stream of gas to spin a microturbine which turns an electrical generator, or operate a pneumatic device.

U.S. Pat. No. 7,977,807 describes the use of a hydraulic or pneumatic passageway to create a wearable, portable, washable, and relatively unobtrusive device for converting movement of a relatively large portion of the human body into electricity. The described device includes a flowable substance, passageways through which the flowable substance flows that are worn over the exterior of the human body, and energy-converting members that convert the energy of the flow of the flowable substance into electricity.

U.S. Pat. No. 7,107,706 describes a medical therapy system that includes surfaces provided with adjustable contour, transient force damping and temperature. The described theory system can be applied to footwear, seating surfaces and cryotherapy devices. The cooling and cryotherapy system employs an evaporator in close proximity to skin, and therefore employs methods to reduce the risk of frostbite.

Despite the forgoing, there is a recognized need for a human motion controlled wearable refrigeration device as disclosed herein.

DETAILED DESCRIPTION

Figure 1C:
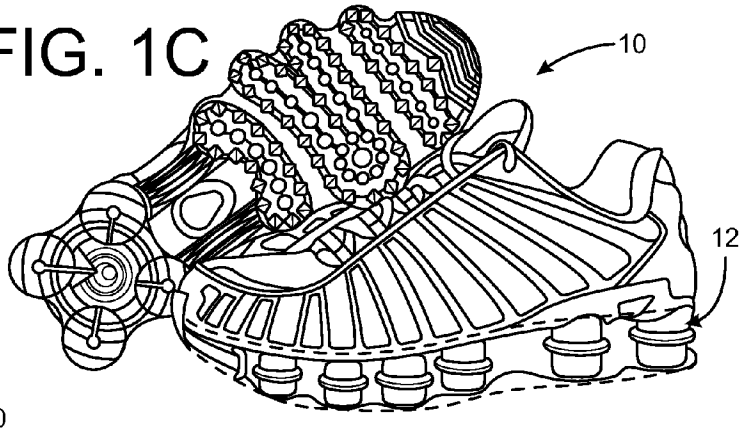
FIGS. 1A-1E together illustrate one example of a refrigerating footwear device in accordance with the teachings of the present invention.
Figure 1D:
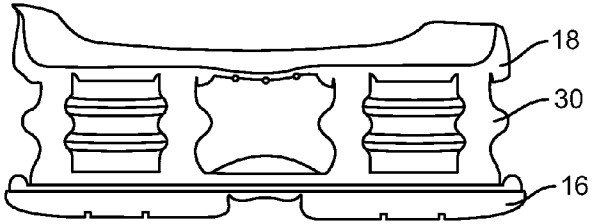

The following description of example methods and apparatus is not intended to limit the scope of the description to the precise form or forms detailed herein. Instead the following description is intended to be illustrative so that others may follow its teachings.

The present disclosure generally describes a wearable, portable, self-contained refrigeration/cooling garment. In one example, the garment may effectively convert the energy of human movement into heat flux. The heat flux can then be used to actively control the temperature of the human body or of part of it. In one example of the present disclosure, the garment is a type of footwear powered by the wearer's ambulation.

Referring now to FIGS. 1A-1E, an example of a refrigerating footwear device, such as a shoe 10 is illustrated. In this example, the shoe 10 includes a footbed 12 comprising an integrated refrigeration device 14. As illustrated, the footbed 12 generally includes a midsole portion 16 and an insole portion 18 at least partially defining a space 20 at least partially containing the refrigeration device 14. In the illustrated example, the refrigeration device 14 includes a plurality of distributed chambers 30 extending between the midsole 16 and the insole 18, wherein the chambers 30 are operatively, fluidly coupled via at least one channel 32. As will be described in greater detail below, the chambers 30 may be divided into at least two groupings (chamber group

Figure 1E:
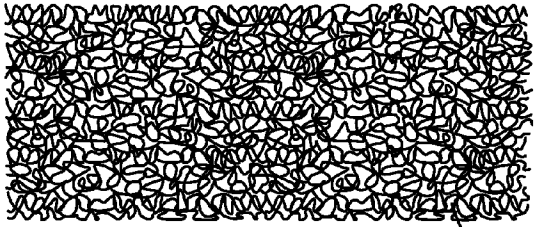
Figure 1A:
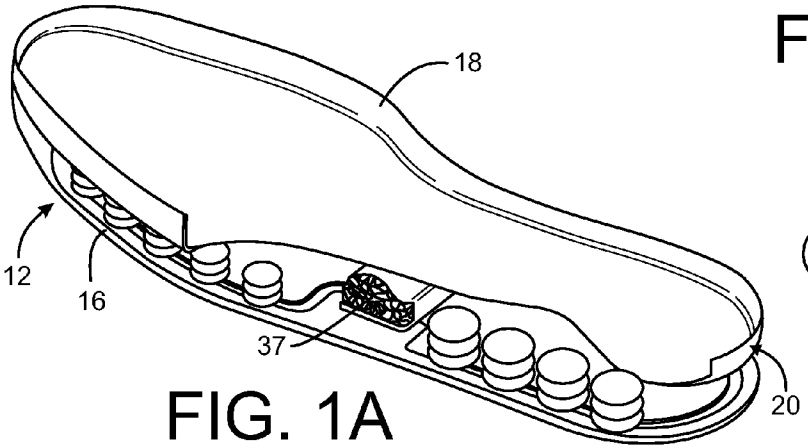
Figure 1B:
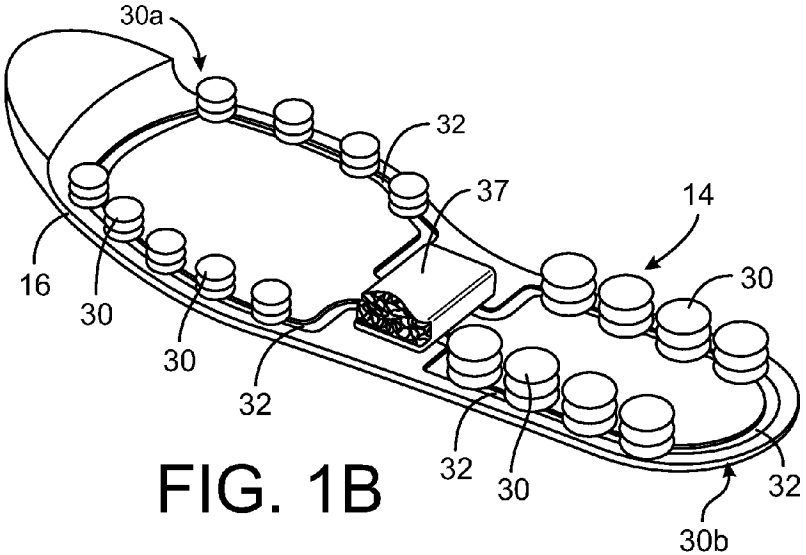

30*a* and 30*b*, respectively) and the groups 30*a*, 30*b*, may be operatively coupled to a regenerator 37 disposed between the two chamber groups. In the present example, the regenerator may be any suitable thermal inertia element including, for example, a porous metal sponge as illustrated in FIG. 1E. In addition, in this example, the chambers 30 and the channels 32 are each filled with air, although it will be appreciated by one of ordinary skill in the art that the fluid may be any suitable gas, liquid, or otherwise. Furthermore, the chemical makeup of the fluid may be any suitable combination.

It will be further understood that the chamber 30 and the channels 32 may be separately or integrally formed with the shoe 10, and more particularly with the insole 18 and midsole 16 as desired. Furthermore, it will be appreciated by one of ordinary skill in the art that the location of the components of the refrigeration device 14 (e.g, the chambers 30, the channels 32, and the regenerator 37) may be located at any suitable location within the shoe 10. Still further, the refrigeration device 14 can be suitable coupled to any garment and/or article worn or otherwise handled by a wearer as long as the general operating principles of the device 14 are suitably achieved.

Figure 3A:
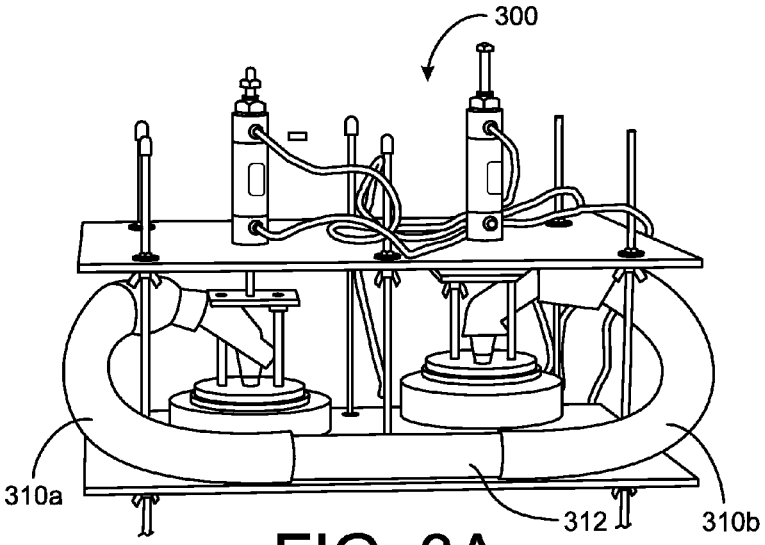
FIG. 3A is an example of another Stirling device in accordance with the teachings of the present invention.

The physical principle exploited in this disclosure relies on the Stirling cycle which allows obtaining a temperature difference (and a corresponding heat flux) by converting an external mechanical input. This principle may be illustrated in the device 300 illustrated in FIG. 3A. In the disclosed example device 300, a basic Stirling refrigerator can be built out of a pair of flexible structures, such as a flexible chamber 310*a*, and a flexible chamber 310*b*, operatively coupled to, and separated by a porous material defining a regenerator 312. By properly miniaturizing this device 300 into the refrigeration device 14 (e.g. shoes), the device 14 is able to harvest the energy from human motion and converting it into usable heat flux.

Figure 3B:
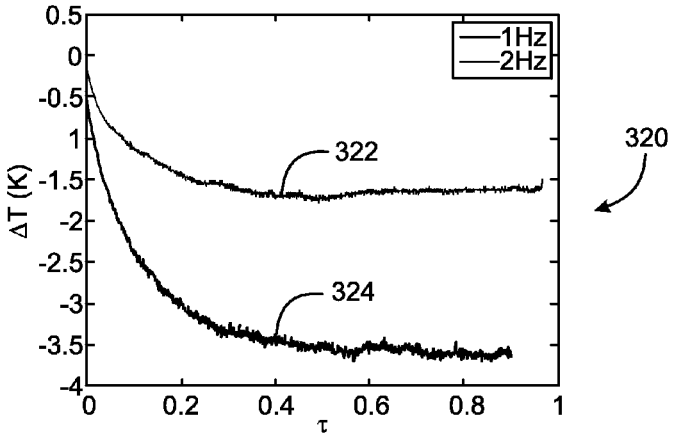
FIG. 3B is an illustration of experimental data showing the time evolution of a temperature difference between two chambers of the example Stirling device of FIG. 3A.

As illustrated in FIG. 3B, a plot 320 of experimental data shows the time evolution (non-dimensional time scale $\tau$) of the temperature difference between the two chambers.

The human body performance and recovery from intense efforts are drastically affected by the ability to rapidly cool the body's core temperature back to normal values. It is fairly well known that by refrigerating specific parts of the body, such as the hands' palms, the core body's temperature can be quickly reduced to normal values after intense physical activity. This result is possible due to the high concentration in certain parts of the body (e.g. hands, feet, face etc.) of a specific vein type that is responsible for the thermal regulation of the body. These specialized veins, known as AVA (Arteriovenous Anastomoses), are mainly devoted to temperature control. Experimental results have shown that proper refrigeration of these veins is extremely effective in increasing the exercise recovery and performance, and can ultimately affect the endurance of the human body during prolonged physical efforts.

Although initially investigated for its possible impact on athletes' performance, this effect can have critical implications on the performance and endurance of other wearers in various situations, such as for instance, soldiers on the battle field, particularly when operating in a high temperature environment. In fact, it can be realistically envisioned that gloves, shoes or even suits able to maintain or rapidly cool down the body temperature at normal values can be used to enhance the performance and resilience of soldiers to prolonged physical efforts. Despite the discovery and experimental validation of this very promising biomedical effect, current known technologies do not allow for the implementation of portable and wearable refrigerating devices. To-date, refrigerating gloves have been developed only for laboratory testing. These gloves use cold water injected in the glove liner in order to control the temperature and requires bulky equipment to pump and maintain the temperature of the working fluid. It follows that this device is not suitable for practical implementation out of a laboratory or a medical facility environment.

Accordingly, the present device, such as the shoe 10 enables the fabrication of wearable items with fully embedded and autonomous refrigerating capabilities. In particular, the present disclosure includes the device (e.g., refrigeration device 14) that can be fully integrated into the shoe 10, and that can harvest the mechanical work produced by the motion of the human body and convert it into heat. This heat flux is then used to cool down selected parts of the human body. It will be appreciated by one of ordinary skill in the art that this device 14 can be used in at least two different modalities: (1) as a main "refrigeration pump" connected to a specially designed suit with an internal liner in order to achieve full body temperature control, or (2) to control the temperature of AVAs in the lower limbs for improved recovery and performance.

Figure 2:
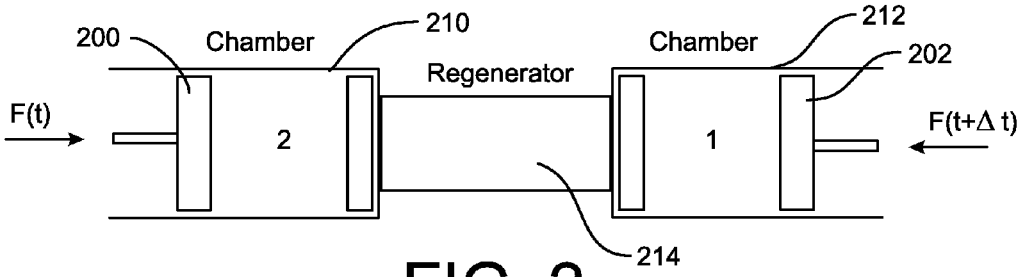
FIG. 2 is an example of a Stirling device.

The shoe 10 is generally based on the physical principle of a Stirling refrigerator. In conventional Stirling devices (see for example FIG. 2) two pistons 200, 202 are driven by an external mechanical input (not shown) forcing a working fluid (e.g. air) to flow cyclically between two chambers (210, 212) connected by a thermal inertia element, called regenerator 214. The periodic motion of the pistons 200, 202 and the corresponding periodic flow of air in the regenerator 214 result in a temperature gradient between the two chambers 210, 212 and in a net heat flux. Due to this temperature gradient one chamber increases its temperature while the other reduces it over time. Realistically the system can be used as either a heat pump or a refrigerator depending on what chamber is utilized for temperature control.

Based on the operating cycle of a Stirling refrigerator the example refrigeration device 14 is embedded in the midsole 16 is able to convert the work produced by the human body during ambulation into heat flux. As described above, to achieve this goal the device 14 comprises two or more flexible chambers 32 and the regenerator 37. In this example, the flexible chambers 32 replace the pistons 200, 202 in the conventional Stirling machine design. During ambulation, the flexible chambers 32 are periodically compressed by the force exerted by the human body therefore forcing the working fluid (e.g. air) to flow through the regenerator 37 and into the adjacent chamber 32. The result of this process is a temperature gradient between the two chambers 32.

Preliminary numerical and experimental studies have included a detailed one dimensional mathematical nonlinear model of a conventional Alpha Stirling refrigerator able to capture the effects of different input and design parameters on the performance of the device 10. This model provided detailed insight into the operating conditions of the Stirling device as well as a very effective modeling tool to evaluate the impact of different design parameters on the generation of heat flux. As an example, this model provided insight on the effect of the relative phase between the pistons showing that this parameter is one of the main contributor determining amplitude and direction of the heat flux. Additionally, the example device 300 was utilized in order to show the feasibility of the concept and acquire preliminary data to characterize the performance of the shoe 10 including the device 14. In the device 300 the regenerator 312 was implemented by a dense distribution of copper rods in a hollow plastic (HDPE) cylinder.

Although further experimental testing is currently ongoing, preliminary results demonstrate the feasibility of the design and the ability to get a net heat flux. For instance FIG. 3B shows the time history of the temperature difference between the two chambers 310*a*, 310*b* of the Stirling device 300 given an input at the different frequencies of 1 Hz (plot 324) and 2 Hz (plot 322). As is illustrated, it can be seen that the temperature difference is higher at lower frequency (1 Hz; plot 324) than at the higher frequency (2 Hz; plot 322). This different may be exploited to extract more energy during regular (low-pace) walking cycles. It is noted that in order to mimic a normal human cadence, the test also utilized a non-perfectly periodic input (results not shown), which are more representative of a realistic walking cycle. Due to the nonlinear character of the system dynamics, this input results in noise-like oscillations produced by the heat flux at nonlinear harmonics. These oscillations are also visible in the periodic 1 Hz and 2 Hz cases but are dramatically amplified by non-periodic inputs. We highlight that, despite these nonlinear effects, a net temperature difference is always attainable. It is also observed that the design of the Stirling device 300 in FIG. 3A was not optimized, therefore the measured temperature differences are not indicative of the maximum achievable performance.

Thus, it can be understood that the example Stirling based refrigerating shoe 10 is able to harvest the mechanical energy produced by human ambulation and convert it into heat flux. The heat flux can then be used to actively control the temperature of feet, lower limbs or even the entire body (if connected to a properly design suit, not shown).

Referring again to the shoe 10 of FIG. 1, during a normal the walking cycle, bellows (e.g., the chambers 30) on separate paths (30*a*, 30*b*) compress or expand differently therefore controlling the phase and the amount of working fluid traversing through the regenerator 37. As noted previously, the example regenerator 37 comprises a metallic porous materials (FIG. 1E), although other materials may be suitable as desired. Specifically, it will be understood that the density and porosity can be adjusted to tune the performance of the device 14. The heat transfer from the chambers 30 to the interior of the shoe 10 may be designed in different ways, for example, using a liner for the circulation of the refrigerating fluid or by designing a system generating advective heat flux.

Figure 4A:
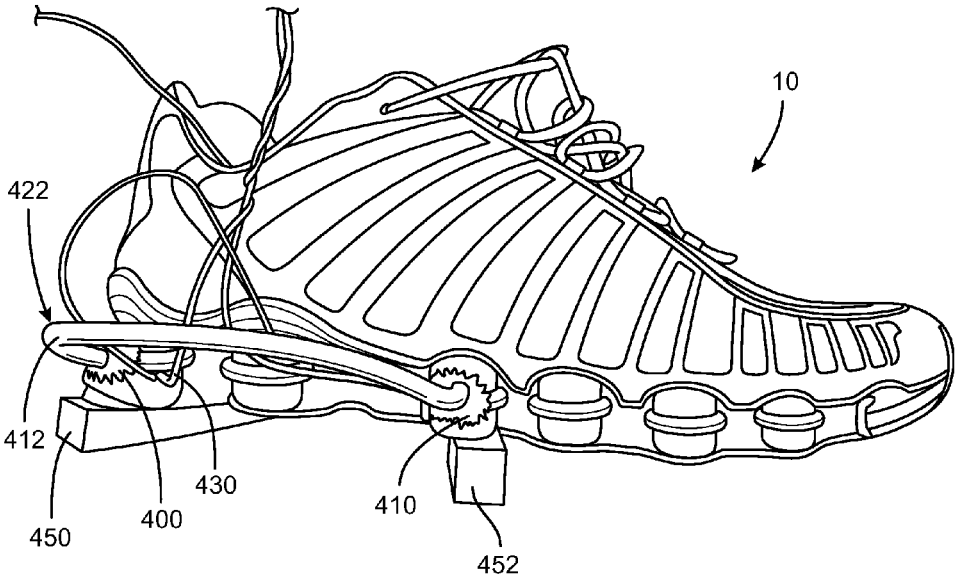
FIGS. 4A and 4B illustrate an example of a refrigerating footwear device in accordance with the teachings of the present invention.
Figure 4B:
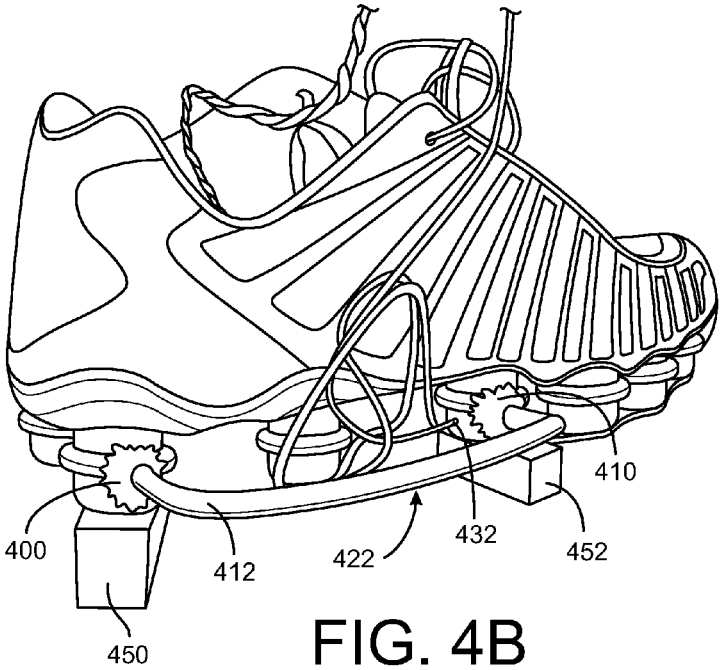

Referring to FIGS. 4A and 4B, there is illustrated a second example of the shoe 10 of FIG. 1. In this example, the shoe 10 includes a first air chamber 400 located near the heel of the shoe 10, and a second air chamber 410 located near the toe of the shoe 10. In this example, the second air chamber 410 is illustrated as being approximately two thirds of the way towards the toe, but it will be appreciated by one of ordinary skill in the art that the location of the chambers 400, 412, may vary as desired, and further, the number and size of the chambers may vary as desired. Also in this example, the first air chamber 400 is larger in size, i.e., has a greater chamber volume, than the second air chamber 410. It will be understood, however, that the chamber may be similar in size or the second air chamber 410 may be larger than the first air chamber 400 as desired. Furthermore, in this example, the chamber 400 and 410 are mechanically independent of any neighboring chamber and are free to be independently compressed.

As shown, the example shoe 10 includes a silicon tube 420 coupled between the first chamber 400 and the second chamber 410. The silicon tube comprises a set of twisted copper wires (hidden from view). As a consequence, the silicon tube 420 serves as a regenerator 422. It will be understood be one of ordinary skill in the art that any suitable device may be utilized as a regenerator.

Still further, in this example arrangement, the shoe 10 includes an optional pair of K-type thermocouples 430, 432, operably coupled to a respective one of the two chambers 400, 412. For instance, in this example, the thermocouples 430, 432 are inserted into the chambers 400, 412. Still further, the example thermocouples 430, 432 are configured in a differential mode such that the temperature difference between the two chambers 430, 432 will produce a measurable voltage. It will be understood that the shoe 10 can, if utilized, employ any suitable device for measuring the temperatures of the chambers 400, 412, and the chosen device may employ any suitable method of measuring the temperature.

As noted, in this example, the thermocouples 430, 432 produce a voltage that is measurable, by way of example, by an external multimeter. As configured in this example, the thermocouples are configured such that 40 microvolts is equivalent to one degree Celsius (1° C.). In addition, as will be appreciated by one of ordinary skill in the art, in this configuration, the initial reading of the thermocouple, i.e., the offset reading before any compression, may be subtracted out such that the only measurable change in the voltage is due to the temperature change.

In the illustrated example, the shoe 10 includes a pair of wedges 450, 452, adhered to the bottom chamber 400, 410, which are included merely for experimental purposes (i.e., to make compression of the chambers 410, 412 easier) and are not necessary for normal operation.

The example shoe 10 of FIGS. 4A, 4B was then subjected to a dynamic test of approximately 120 steps. In this instance, each step comprised the compression of one chamber, releasing the chamber, and then compressing the other chamber to mimic a normal walking motion. The temperature difference measured by the thermocouples 430, 432 changed with respect to time until it reached a steady value. In this dynamic test, compression of the chamber 400 made the chamber hotter and the voltage reading was negative. Compression of the chamber 410, meanwhile, made that chamber hotter and thus the measured reading was positive. Thus, the sign of the voltage measurement was an indication as to which chamber was getting hotter (e.g., a negative measurement meant the chamber 400 while a positive measurement meant the chamber 410). Compression of both chambers at the same time had no effect on the temperature difference between the two chambers.

To observe the efficiencies in the shoe 10, eighteen dynamic tests were conducted with approximately five hours rest between the tests. During the rest period, the temperature differences normalized to zero. The results of the dynamic tests indicated an average temperature change of 1.4° C. (plus or minus 0.5° C.) after 119 steps (plus or minus 27.8 steps). In this setup, the chamber 400 typically was hotter than the chamber 410. This phenomena is likely due to the asymmetry of the two chambers 400, 410, where the two chambers differ in volume. As such in this instance, the chamber 410 was more difficult to compress than the chamber 400. Accordingly, it was experimentally clear that a significant temperature difference was achieved after about 150 steps.

As demonstrated by the dynamic tests, the shoe 10 illustrates that a self-refrigerated footwear may be powered by the mechanical energy produced by the human body during ambulation. In addition, the footwear may be connected to an external device, such as for instance a refrigeration suit, etc. to serve as the "main engine" to refrigerate the external device. Still further, it will be appreciated that the cooling/heating capacity of the shoe 10, or any device utilizing the disclosed mechanism can be reversible and can be used both for heating or refrigeration purposes as desired.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents

We claim:

1. A refrigeration generating footwear comprising:

a midsole; and a refrigeration device coupled to the midsole, the refrigeration device comprising:

a compressible first chamber;

a compressible second chamber, separate from the first chamber; and a porous sponge fluidly coupled between the first chamber and the second chamber, wherein the first chamber, the second chamber, and the porous sponge form a closed system configured to maintain a fluid, wherein ambulatory movement of a wearer of the refrigeration generating footwear causes the fluid to traverse between the first chamber and the second chamber to create a heat flux between the first chamber and the second chamber, and wherein the heat flux is configured to be utilized by the wearer to at least one of cool or heat at least a portion of the wearer.

2. A refrigeration generating footwear as recited in claim 1, wherein the refrigeration device is integrated into the midsole.

3. A refrigeration generating footwear as recited in claim 1, wherein a volume of the first chamber is substantially similar to a volume of the second chamber.

4. A refrigeration generating footwear as recited in claim 1, wherein a volume of the first chamber is different than a volume of the second chamber.

5. A refrigeration generating footwear as recited in claim 1, wherein the first chamber has a different compressibility than the second chamber.

6. A refrigeration generating footwear as recited in claim 1, wherein the fluid is air.

7. A refrigeration generating footwear as recited in claim 1, wherein at least a portion of the porous sponge is formed within the midsole.

8. A refrigeration generating footwear as recited in claim 1, wherein at least one of the first or second chambers comprises a plurality of fluidly coupled sub-chambers.

9. A refrigeration generating footwear as recited in claim 1, wherein the porous sponge is a porous metal sponge.

10. A refrigeration generating footwear as recited in claim 1, wherein the compressible first chamber is generally located in a heel portion of the midsole and the compressible second chamber is generally located in ball portion of the midsole.

11. A refrigeration generating footwear as recited in claim 1, further comprising an external device operably coupled to the refrigeration device, wherein the heat flux is utilized to at least one of cool or heat the external device.

12. A refrigeration generating footwear as recited in claim 11, wherein the external device is a wearable article.

13. A refrigeration generating footwear as recited in claim 1, wherein the created heat flux is locatable proximate an arteriovenous anastomosis of the wearer.

* * * * *